US011225850B2

(12) United States Patent
Al-Mousa et al.

(10) Patent No.: US 11,225,850 B2
(45) Date of Patent: Jan. 18, 2022

(54) CUTTING A TUBULAR IN A WELLBORE

(71) Applicant: Saudi Arabian Oil Company, Dhahran (SA)

(72) Inventors: Ahmed Al-Mousa, Dhahran (SA); Ahmed A. Al-Ramadhan, Dammam (SA); Qadir Looni, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/672,923

(22) Filed: Nov. 4, 2019

(65) Prior Publication Data

US 2021/0131212 A1 May 6, 2021

(51) Int. Cl.
*E21B 29/02* (2006.01)
*E21B 47/09* (2012.01)

(52) U.S. Cl.
CPC ..... *E21B 29/02* (2013.01); *E21B 47/09* (2013.01)

(58) Field of Classification Search
CPC ..... E21B 29/02; E21B 43/248; E21B 43/263; E21B 43/1185; F42B 3/121; F42B 3/122
See application file for complete search history.

(56) References Cited

U.S. PATENT DOCUMENTS 2,935,020 A * 5/1960 Howard ..... E21B 29/02 102/307
5,129,956 A 7/1992 Pickering et al.
5,698,814 A * 12/1997 Parsons ..... B26F 3/04 102/307
5,924,489 A 7/1999 Hatcher
6,808,023 B2 10/2004 Smith et al.
7,117,956 B2 10/2006 Grattan et al.
7,249,633 B2 7/2007 Ravensbergen et al.
7,363,860 B2 * 4/2008 Wilson ..... F42B 3/02 102/205
9,903,192 B2 * 2/2018 Entchev ..... E21B 43/263
2003/0047312 A1 3/2003 Bell
2010/0051265 A1 * 3/2010 Hurst ..... E21B 43/1185 166/250.01
2012/0085538 A1 * 4/2012 Guerrero ..... E21B 43/14 166/284

(Continued)

FOREIGN PATENT DOCUMENTS

NO 20170293 8/2018
WO 2012161854 11/2012

OTHER PUBLICATIONS

PCT Invitation to Pay Additional Fees and Where Applicable, Protest Fees in International Appln. No. PCT/US2020/058668, dated Mar. 1, 2021, 18 pages.

(Continued)

*Primary Examiner* — Cathleen R Hutchins
(74) *Attorney, Agent, or Firm* — Fish & Richardson P.C.

(57) ABSTRACT

A downhole tool includes a streamlined housing sized to freely move through a wellbore formed from a terranean surface to a subterranean formation; an explosive material enclosed within an interior volume of the housing, the explosive material sufficient to cut at least a portion of a tubular positioned in the wellbore upon detonation; a detonator coupled to the explosive material; and a detonator control system communicably coupled to the detonator and configured to activate the detonator with a detonation signal to detonate the explosive material.

25 Claims, 4 Drawing Sheets

(56) References Cited

U.S. PATENT DOCUMENTS

| | | | | |
|---|---|---|---|---|
| 2012/0241146 | A1* | 9/2012 | Umphries | E21B 23/01 166/241.1 |
| 2013/0062055 | A1* | 3/2013 | Tolman | E21B 43/119 166/250.01 |
| 2013/0299194 | A1 | 11/2013 | Bell | |
| 2015/0275649 | A1* | 10/2015 | Orban | E21B 47/09 73/152.54 |

OTHER PUBLICATIONS

PCT International Search Report and Written Opinion in International Appln. No. PCT/US2020/058668, dated Apr. 22, 2021, 25 pages.

* cited by examiner

CUTTING A TUBULAR IN A WELLBORE

TECHNICAL FIELD

This disclosure relates to cutting a tubular in a wellbore and, more particularly, cutting a tubular in a wellbore with a downhole tool that includes an explosive material.

BACKGROUND

Tubular members, such as drill pipe, production casing, and other casings, are often used to explore for and produce hydrocarbons from a subterranean formation to the Earth's surface. In some cases, such tubular members, which are often connected to form a string of such members, may become stuck in the wellbore. Removal of the stuck tubular may be expensive in terms of time and cost.

SUMMARY

This disclosure describes implementations of a downhole tool that may be freely moved through a wellbore to a location in which a damaged or stuck tubular is located. In some aspects, the downhole tool includes an explosive charge sufficient to sever the damaged or stuck tubular within the wellbore.

In an example implementation, a downhole tool includes a streamlined housing sized to freely move through a wellbore formed from a terranean surface to a subterranean formation; an explosive material enclosed within an interior volume of the housing, the explosive material sufficient to cut at least a portion of a tubular positioned in the wellbore upon detonation; a detonator coupled to the explosive material; and a detonator control system communicably coupled to the detonator and configured to activate the detonator with a detonation signal to detonate the explosive material.

In an aspect combinable with the example implementation, at least a part of the streamlined housing includes at least a partial spherical shape.

In another aspect combinable with any of the previous aspects, the at least a part of the streamlined housing includes a first part, and at least a second part of the streamlined housing includes at least a partial cone shape.

In another aspect combinable with any of the previous aspects, the at least partial cone shape includes a rounded cone shape.

In another aspect combinable with any of the previous aspects, the first part includes an uphole end of the housing and the second part includes a downhole end of the housing.

In another aspect combinable with any of the previous aspects, the explosive material is positioned in a part of the interior volume of the housing that includes a star or spoke shaped volume.

In another aspect combinable with any of the previous aspects, the detonator control system includes at least one accelerometer and at least one power source coupled to the accelerometer.

In another aspect combinable with any of the previous aspects, the detonator control system is configured to activate the detonator with the detonation signal based on the accelerometer determining that the housing is substantially stationary within the wellbore.

In another aspect combinable with any of the previous aspects, the detonator control system further includes a timer.

In another aspect combinable with any of the previous aspects, the detonator control system further is configured to activate the detonator with the detonation signal at a predetermined time period measured by the timer subsequent to the accelerometer determining that the housing is substantially stationary within the wellbore.

In another example implementation, a method for cutting a tubular in a wellbore includes moving a downhole tool, independent of a downhole conveyance, through a wellbore formed from a terranean surface to a subterranean formation, the downhole tool including a housing, an explosive material enclosed within an interior volume of the housing, a detonator coupled to the explosive material, and a detonator control system communicably coupled to the detonator; determining, with the detonator control system, that the downhole tool is adjacent a portion of a tubular in the wellbore; based on the determination, providing a detonator activation signal for the detonator with the detonator control system to detonate the explosive material; and cutting the portion of the tubular in the wellbore with the detonated explosive material.

In an aspect combinable with the example implementation, cutting the portion of the tubular includes severing a first portion of the tubular from a second portion of the tubular in the wellbore with the detonated explosive material.

In another aspect combinable with any of the previous aspects, cutting the portion of the tubular in the wellbore with the detonated explosive material includes shattering the housing with the detonated explosive material to generate a plurality of shrapnel from the shattered housing; and cutting the portion of the tubular in the wellbore with the plurality of shrapnel.

In another aspect combinable with any of the previous aspects, moving the downhole tool independent of the downhole conveyance, through the wellbore includes circulating a fluid through the wellbore; moving the downhole tool through the wellbore with the circulated fluid.

In another aspect combinable with any of the previous aspects, at least a part of the housing includes a partial spherical shape.

In another aspect combinable with any of the previous aspects, the part of the housing includes a first part, and a second part of the streamlined housing includes a partial cone shape.

In another aspect combinable with any of the previous aspects, the partial cone shape includes a rounded cone shape.

In another aspect combinable with any of the previous aspects, the first part includes an uphole end of the housing and the second part includes a downhole end of the housing.

In another aspect combinable with any of the previous aspects, the explosive material is positioned in a part of the interior volume of the housing that includes a star- or spoke-shaped volume.

In another aspect combinable with any of the previous aspects, determining, with the detonator control system, that the downhole tool is adjacent the portion of the tubular in the wellbore includes determining, with at least one accelerometer of the detonator control system, that the housing is substantially stationary within the wellbore; and based on the determination that the housing is substantially stationary within the wellbore, providing the detonator activation signal for the detonator with the detonator control system to detonate the explosive material.

In another aspect combinable with any of the previous aspects, determining, with the detonator control system, that the downhole tool is adjacent the portion of the tubular in the wellbore includes determining, with at least one accelerometer of the detonator control system, that the housing is substantially stationary within the wellbore; determining, with a timer of the detonator control system, that a predetermined time period subsequent to the determination that the housing is substantially stationary within the wellbore has expired; and based on the determination that the predetermined time period has expired, providing the detonator activation signal for the detonator with the detonator control system to detonate the explosive material.

In another example implementation, a wellbore tubular cutting apparatus includes a partially spherical metal housing that encloses an explosive charge, the partially spherical metal housing configured for deployment through a wellbore independent of a working string or a downhole conductor; a detonator embedded in the explosive charge; and a control system communicably coupled to the detonator. The control system is configured to perform operations including determining that the partially spherical metal housing has reached a particular position in the wellbore; and transmitting a detonation signal to the detonator to detonate the explosive charge.

In an aspect combinable with the example implementation, the partially spherical metal includes a steel housing.

In another aspect combinable with any of the previous aspects, the partially spherical metal housing includes an uphole end that is spherical and a downhole end that is conical.

In another aspect combinable with any of the previous aspects, the explosive charge is sufficient, when detonated, to fragment the partially spherical metal housing and sever a wellbore tubular.

In another aspect combinable with any of the previous aspects, the explosive charge is enclosed within a volume of the partially spherical metal housing.

In another aspect combinable with any of the previous aspects, the volume includes a center portion that encloses the explosive charge and a plurality of nozzles that extend toward a wall of the housing from the center portion.

Implementations of a downhole tool according to the present disclosure may include one or more of the following features. For example, the downhole tool may operate to cut stuck tubing above a collapse or plugged depth without a need to rig up wireline equipment on top of the tubing at a terranean surface to run wireline cutters downhole. The downhole tool may therefore help avoid or prevent a safety risk if the tubing is filled with flammable hydrocarbon fluids at high pressure. As another example, the downhole tool may be dropped at a suction point or a wellbore and pumped down the tubing to reach a cutting depth without the need for mechanical downhole conveyances, such as work strings or wirelines.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
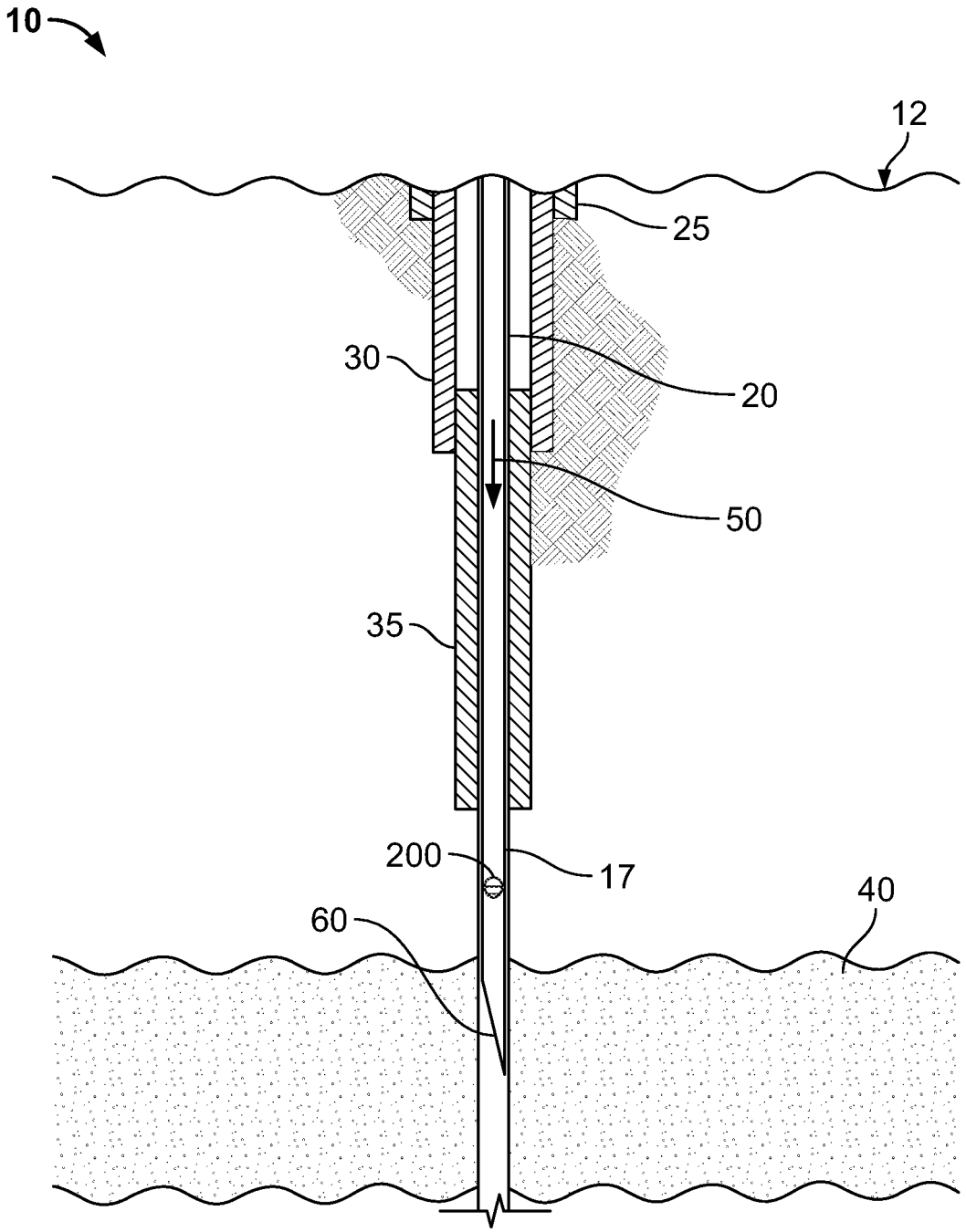
FIG. 1 is a schematic diagram of an example wellbore system that includes a downhole tool according to the present disclosure.

FIG. 1 is a schematic diagram of an example wellbore system 100 including a downhole tool 200. Generally, FIG. 1 illustrates a portion of one embodiment of a wellbore system 10 according to the present disclosure in which the downhole tool 200 may be run into a wellbore 20 and activated when the tool 200 reaches a particular location of a wellbore tubular 17 (or simply, tubular 17) within the wellbore 20. The downhole tool 200 includes an explosive charge that may be detonated to cut or sever the tubular 17 within the wellbore 20. Once cut or severed, the tubular 17 (for example, in multiple pieces) may be fished to a terranean surface 12.

As shown, the wellbore system 10 accesses a subterranean formation 40 and provides access to hydrocarbons located in such subterranean formation 40. In an example implementation of system 10, the system 10 may be used for a production operation in which the hydrocarbons may be produced from the subterranean formation 40 within the wellbore tubular 17 (for example, as a production tubing or casing). However, tubular 17 may represent any tubular member positioned in the wellbore 20 such as, for example, coiled tubing, any type of casing, a liner or lining, another downhole tool connected to a work string (in other words, multiple tubulars threaded together), or other form of tubular member.

A drilling assembly (not shown) may be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and intermediate casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellb ore 20 may than extend vertically downward. This portion of the wellbore 20 may be enclosed by the intermediate casing 35.

As shown, the downhole tool 200 may be run into the wellbore 20 and through the tubular 17. In some aspects, as shown, the downhole tool 200 may be inserted into the wellbore 20, which may be filled with a fluid, such as a drilling fluid or otherwise. In such aspects, the downhole tool 200 may be oriented and weighted (as discussed in more detail later) to move downhole from the terranean surface 12 and toward the subterranean formation 40 through the wellbore fluid.

In some aspects, the wellbore fluid is not static in the wellbore 20 but is a circulated (for example, pumped) wellbore fluid 50 that dynamically moves the downhole tool 200 through the wellbore 20. Thus, in some aspects, the downhole tool 200 is moved through the wellbore 20 in a fluid (either static or dynamic) without being connected to any other form of downhole conveyance, such as a working string or downhole conductor (for example, wireline or slickline or other conductor).

As shown in FIG. 1, the wellbore tubular 17 may include a stuck or damaged portion 60 within the wellbore 20. In some aspects, the damaged portion 60 may block or restrict the wellbore 20 and needs to be removed from the wellbore 20. As explained in more detail later, the downhole tool 200 may be moved to and positioned within the wellbore 20 adjacent the damaged portion 60 of the tubular 17. The downhole tool 200 may then be activated to cut or sever the damaged portion 60 of the tubular 17 from the undamaged portion of the tubular 17 (for example, uphole of the damaged portion 60).

Figure 2A:
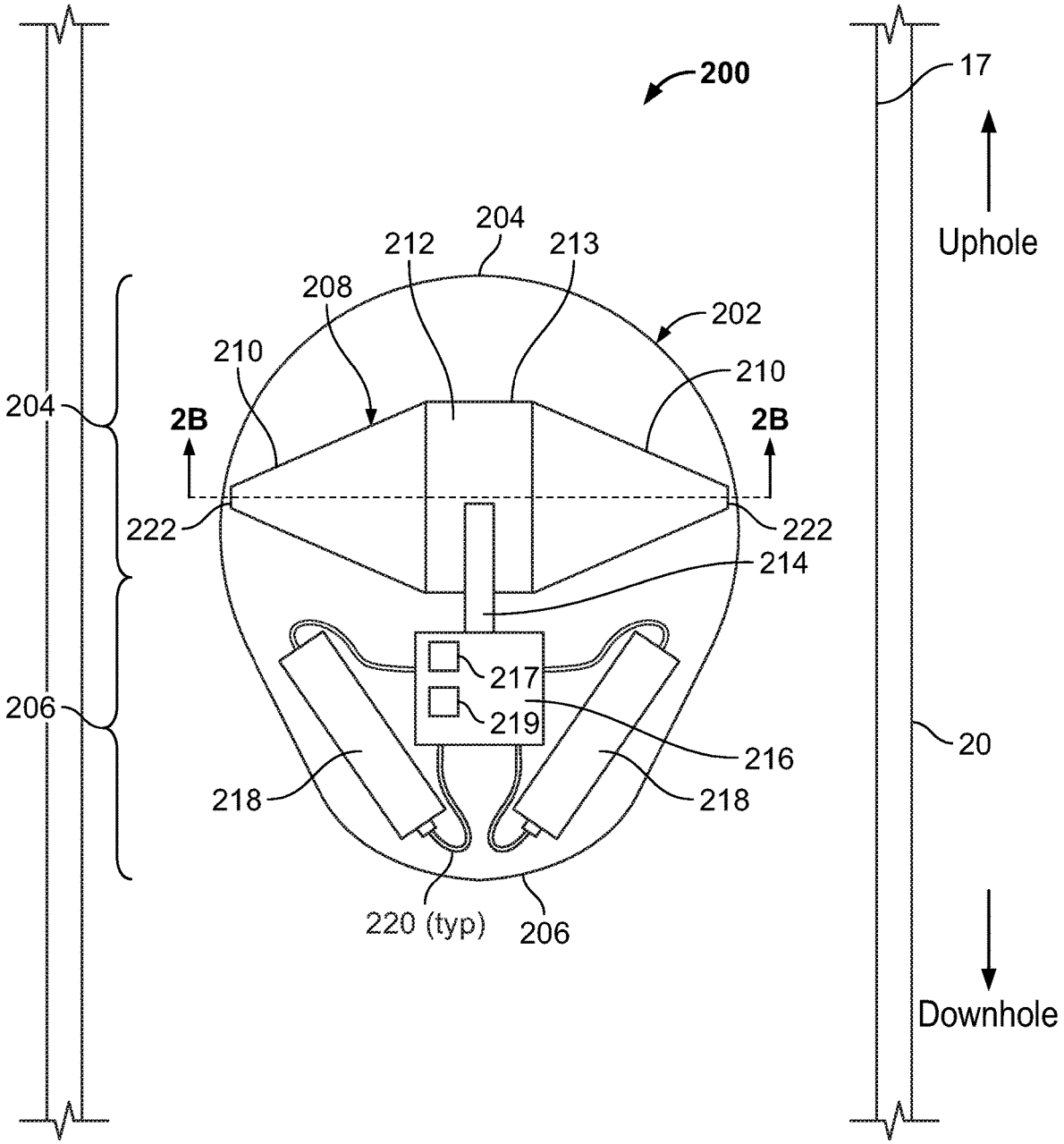
FIG. 2A is a schematic diagram of a downhole tool according to the present disclosure within a wellbore tubular.
Figure 2B:
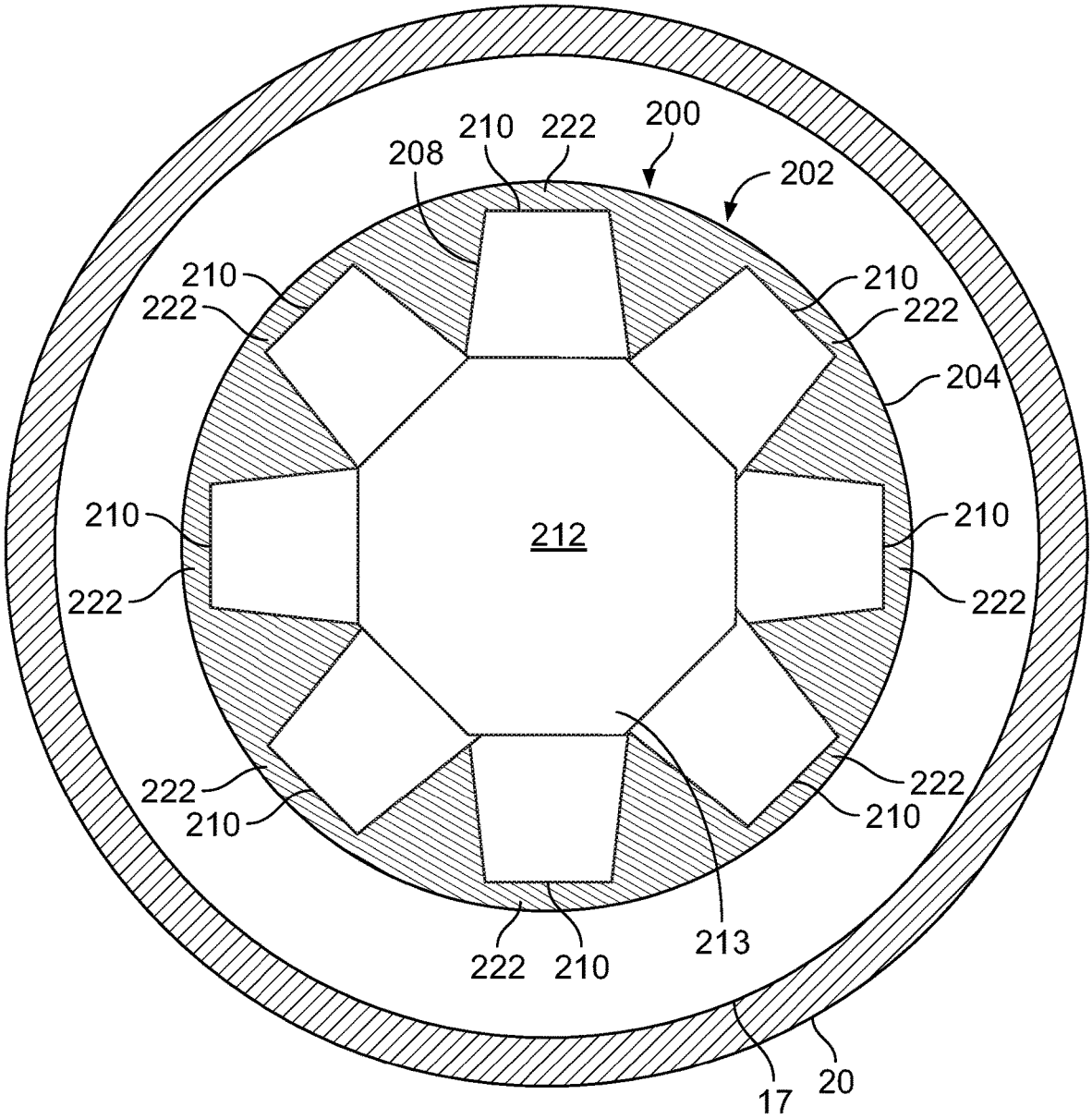
FIG. 2B is a sectional view of a portion of the downhole tool shown in FIG. 2A.

FIGS. 2A-2B are schematic diagrams of the downhole tool 200 shown in FIG. 1. FIG. 2A is a schematic diagram of the downhole tool 200 shown in a vertical cross-section within the wellbore tubular 17 and wellbore 20. FIG. 2B is a schematic diagram of the downhole tool 200 shown in a horizontal cross-section view of FIG. 2A. As shown in these figures, the downhole tool 200 includes a housing 200 that includes an uphole (or upper) portion 204 and a downhole (or lower) portion 206. As shown in this particular example implementation, the upper portion 204 is spherically, or at least partially spherically, shaped. The lower portion 206 is conical, or at least partially conical, in shape. As shown, the conical portion of the housing 202 may have a rounded end (for instance, rather than a sharply pointed conical end).

In some aspects, the particular shapes of the upper portion 204 and lower portion 206 of the housing 202 may provide for a streamlined housing that allows the downhole tool 200 to move through, for example, a fluid-filled wellbore. Further, in some aspects, the particular shapes of the upper portion 204 and lower portion 206 of the housing 202 may keep or help keep the downhole tool 200 at a particular orientation, with the upper portion 204 at an uphole end and the lower portion 206 at a downhole end, while the downhole tool 200 is moving through the wellbore 20 (and the tubular 17). Further, in some aspects, the downhole tool 200 may be sized (for example, dimensions of the housing 202) such that, once oriented in the wellbore 20 with the lower portion 206 pointed downhole and the upper portion 202 pointed uphole, the downhole tool 200 cannot twist or turn to a different orientation within the wellbore 20.

In some aspects, the housing 202 may be formed from a fragmentable material, such as steel or other metal. Further, a steel housing 202 may, along with the shaped portions as described, help keep the downhole tool 200 in a particular orientation while moving through the wellbore 20 (through a particular weight distribution of the material in the housing 202).

As shown in FIGS. 2A-2B, an interior volume 208 is formed within the housing 202 that comprises a void space. The interior volume 208 may include a center void 213 in which an explosive material 212 is enclosed. The interior volume 208 also includes, in this example, a number of nozzle spaces 210 that radially extend toward an edge of the housing 202 from the center void. The nozzles 212, as shown, may be defined by a dimension at the center void 213 that is larger than a dimension at an end near the edge of the housing 202.

As shown, the center void 213 has an octagonal cross section (shown in FIG. 2B); however, any shape of center void 213 is contemplated by the present disclosure. In addition, while the illustrated example includes eight nozzles 212 (due to the octagonal shape of the center void 213), more or fewer nozzles 212 are contemplated by the present disclosure as well. As shown, a wall thickness 222 of the housing 202 nearest the outlet of the nozzles 212 (furthest from the center void 213) is less than a thickness of the housing 202 at other portions of the downhole tool 200.

Turning back to FIG. 2A, a detonator 214 is shown embedded in the explosive material 212. The detonator 214 is communicably coupled to a detonator control system that includes a detonator controller 215, one or more power sources 218, and one or more power conduits 220 that couple the one or more power sources 218. In some aspects, the detonator control system may operate to activate the detonator 212 to detonate the explosive material 212 when, for example, the downhole tool 200 is positioned at a particular location within the wellbore 20.

In some example, the detonator controller 216 may operate to determine when the downhole tool 200 is at the particular location within the wellbore 20. For example, in some aspects, the detonator controller 216 may include one or more accelerometers 217 that operate to determine a movement (or lack of movement) of the downhole tool 200 within the wellbore 20. For instance, the one or more accelerometers 217 may operate to detect that the downhole tool 200 is not moving, or is not substantially moving (for example, moving slow enough to not register movement), within the wellbore 20. Based on this detection by the one or more accelerometers 217, the detonator controller 216 may generate a detonation signal to the detonator 214 to activate the detonator 214.

In some aspects, the detonator controller 216 may also include a timer 219 in addition to the one or more accelerometers 217. In some aspects, once the one or more accelerometers 217 determine that the downhole tool 200 is not moving, or is not substantially moving (for example, moving slow enough to not register movement), within the wellbore 20, the timer 219 may start a countdown from a specified time duration (for example, 30 seconds, 1 minute, or other time period). Based on the detection by the one or more accelerometers 217 plus the expiration of the specified time duration by the timer 219, the detonator controller 216 may generate a detonation signal to the detonator 214 to activate the detonator 214.

Figure 3:
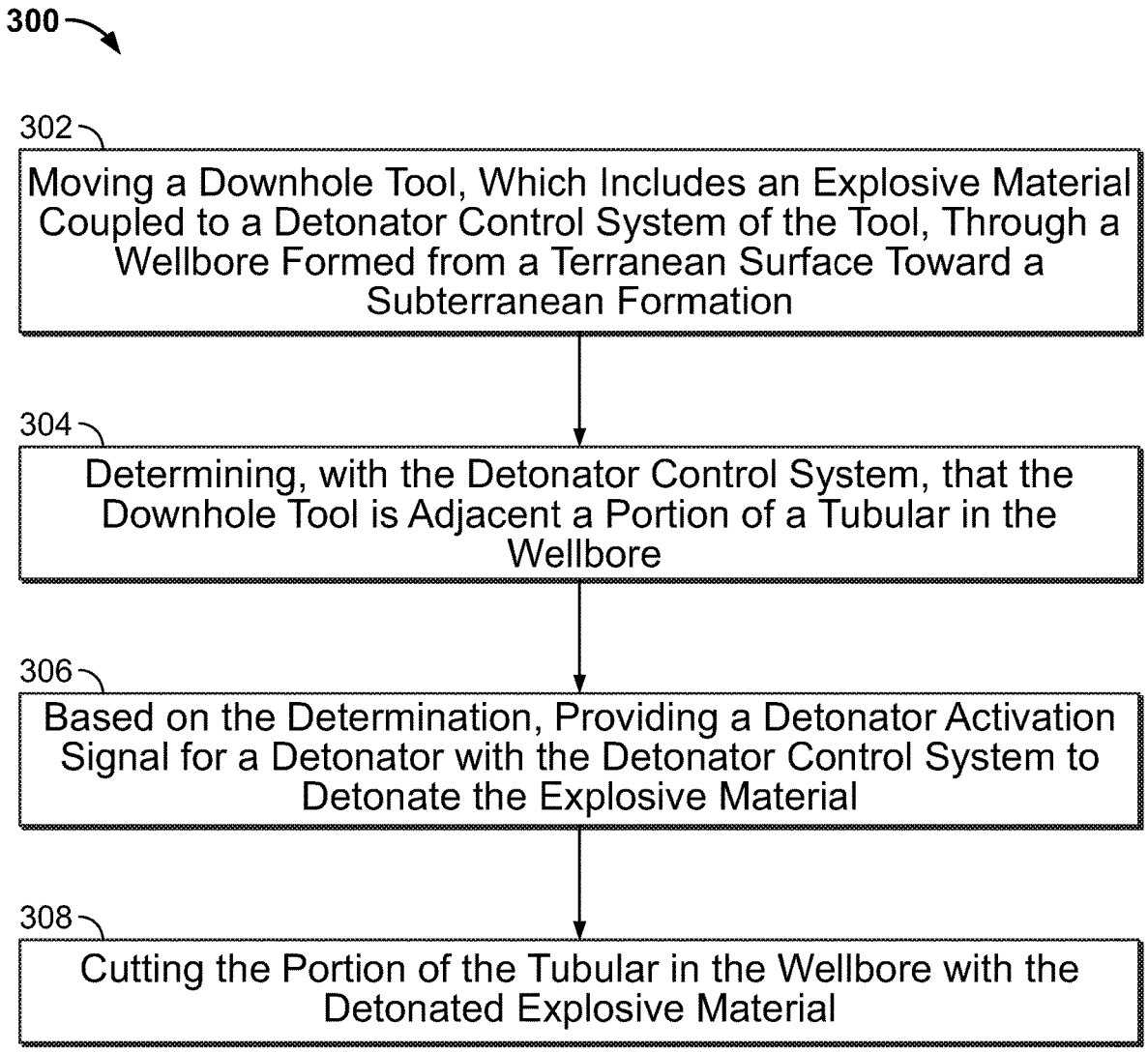
FIG. 3 is a flowchart that describes an example method performed with a downhole tool according to the present disclosure.

FIG. 3 is a flowchart that describes an example method 300 performed with the downhole tool 200. Method 300 may begin at step 320, which includes moving a downhole tool, which includes an explosive material coupled to a detonator control system of the tool, through a wellbore formed from a terranean surface toward a subterranean formation. For example, the downhole tool may be moved through the wellbore within a wellbore fluid that is static (for example, not being circulated downhole) or dynamic (for example, circulated or pumped downhole). In some aspects, the downhole tool may be moved independent of, such as not connected to, a downhole conveyance such as a working string, wireline, or other attachable downhole conveyance.

Method 300 may continue at step 304, which includes determining, with the detonator control system, that the downhole tool is adjacent a portion of a tubular in the wellbore. For example, in some aspects, the detonator control system may include one or more position or movement sensors, such as accelerometers or depth gauges. In some cases, the accelerometer(s) may determine that the downhole tool is at a stationary position in the wellbore, such as at a location where a damaged or stuck portion of a tubular prevents further movement of the downhole tool. In some cases, the depth gauge(s) may determine that the downhole tool is at a known wellbore depth at which the tubular is stuck or damaged.

In example aspects, once the determination is made that the downhole tool is at the particular location in the wellbore adjacent the tubular and no substantial movement is detected, a timer of the detonator control system may begin a countdown time duration. For example, to ensure that the downhole tool is stationary and remains stationary, the time duration may be set by the timer to ensure a safety margin (in other words, ensure that any explosive charge is not activated incorrectly in the wellbore or at the surface). In some aspects, if movement is detected (for example, by one or more accelerometers), the specified time duration may be reset.

Method 300 may continue at step 306, which includes based on the determination, providing a detonator activation signal for a detonator with the detonator control system to detonate the explosive material. For example, once the determination in step 304 is made, the detonator control system may send an electric charge (or release an electric charge) to the detonator to detonate the explosive material.

Method 300 may continue at step 308, which includes cutting the portion of the tubular in the wellbore with the detonated explosive material. For example, in some aspects, the detonated explosive charge may break apart or fragment the housing of the downhole tool to generate shrapnel. Thus, in some aspects, the explosive charge, or shrapnel, or both may cut the portion of the tubular in the wellbore. In some aspects, by cutting the tubular, the tubular is severed in the wellbore.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole wellbore tool for cutting a hydrocarbon wellbore tubular, comprising:

a streamlined housing sized and configured to freely move through a hydrocarbon production wellbore formed from a terranean surface to a subterranean formation unattached to a hydrocarbon wellbore downhole conveyance, the streamlined housing comprising an uphole end that comprises an at least partial spherical shape and a downhole end that comprises an at least partial cone shape;

an explosive material enclosed within an interior volume of the housing, the explosive material sufficient to fragment at least a portion of the streamlined housing to create shrapnel to cut at least a portion of the hydrocarbon wellbore tubular positioned in the hydrocarbon wellbore upon detonation;

a detonator coupled to the explosive material; and a detonator control system communicably coupled to the detonator and configured to activate the detonator with a detonation signal to detonate the explosive material.

2. The downhole wellbore tool of claim 1, wherein the at least partial cone shape comprises a rounded cone shape.

3. The downhole wellbore tool of claim 1, wherein the explosive material is positioned in a part of the interior volume of the housing that comprises a star or spoke shaped volume.

4. The downhole wellbore tool of claim 3, wherein the star or spoke shaped volume comprises a center volume portion and a plurality of nozzles fluidly coupled to the center volume, each of the plurality of nozzles extending from the center portion toward the streamlined housing.

5. The downhole wellbore tool of claim 4, wherein the explosive material is positioned in the center volume portion.

6. The downhole wellbore tool of claim 4, wherein each of the plurality of nozzles comprises a first dimension adjacent the center volume portion that is larger than a second dimension adjacent the streamlined housing.

7. The downhole wellbore tool of claim 1, wherein the detonator control system comprises at least one accelerometer and at least one power source coupled to the accelerometer, the detonator control system configured to activate the detonator with the detonation signal based on the accelerometer determining that the housing is substantially stationary within the hydrocarbon wellbore.

8. The downhole wellbore tool of claim 7, wherein the detonator control system further comprises a timer, the detonator control system further configured to activate the detonator with the detonation signal at a predetermined time period measured by the timer subsequent to the accelerometer determining that the housing is substantially stationary within the hydrocarbon wellbore.

9. A method for cutting a hydrocarbon wellbore tubular in a hydrocarbon production wellbore, comprising:

moving a downhole tool, independent of a hydrocarbon wellbore downhole conveyance, through the hydrocarbon production wellbore formed from a terranean surface to a subterranean formation, the downhole tool comprising a housing, an explosive material enclosed within an interior volume of the housing, a detonator coupled to the explosive material, and a detonator control system communicably coupled to the detonator;

determining, with the detonator control system, that the downhole tool is adjacent a portion of the hydrocarbon wellbore tubular in the hydrocarbon production wellbore;

based on the determination, providing a detonator activation signal for the detonator with the detonator control system to detonate the explosive material; and cutting the portion of the hydrocarbon wellbore tubular in the hydrocarbon production wellbore with the detonated explosive material, the cutting comprising:

shattering the housing with the detonated explosive material to generate a plurality of shrapnel from the shattered housing, and cutting the portion of the hydrocarbon wellbore tubular in the hydrocarbon production wellbore with the plurality of shrapnel.

10. The method of claim 9, wherein cutting the portion of the hydrocarbon wellbore tubular comprises severing a first portion of the hydrocarbon wellbore tubular from a second portion of the hydrocarbon wellbore tubular in the hydrocarbon production wellbore with the detonated explosive material.

11. The method of claim 9, wherein moving the downhole tool independent of the hydrocarbon wellbore downhole conveyance, through the hydrocarbon production wellbore comprises:

circulating a fluid through the hydrocarbon production wellbore;

moving the downhole tool through the hydrocarbon production wellbore with the circulated fluid.

12. The method of claim 11, wherein determining, with the detonator control system, that the downhole tool is adjacent the portion of the hydrocarbon wellbore tubular in the hydrocarbon production wellbore comprises:

determining, with at least one accelerometer of the detonator control system, that the housing is substantially stationary within the hydrocarbon production wellbore;

based on the determination that the housing is substantially stationary within the hydrocarbon production wellbore, providing the detonator activation signal for the detonator with the detonator control system to detonate the explosive material.

13. The method of claim 9, wherein at least a part of the housing comprises a partial spherical shape.

14. The method of claim 13, wherein the part of the housing comprises a first part, and a second part of the streamlined housing comprises a partial cone shape.

15. The method of claim 14, wherein the partial cone shape comprises a rounded cone shape.

16. The method of claim 15, wherein the first part comprises an uphole end of the housing and the second part comprises a downhole end of the housing.

17. The method of claim 9, wherein the explosive material is positioned in a part of the interior volume of the housing that comprises a star- or spoke-shaped volume.

18. The method of claim 9, wherein determining, with the detonator control system, that the downhole tool is adjacent the portion of the hydrocarbon wellbore tubular in the hydrocarbon production wellbore comprises:

determining, with at least one accelerometer of the detonator control system, that the housing is substantially stationary within the hydrocarbon production wellbore; and based on the determination that the housing is substantially stationary within the hydrocarbon production wellbore, providing the detonator activation signal for the detonator with the detonator control system to detonate the explosive material.

19. The method of claim 9, wherein determining, with the detonator control system, that the downhole tool is adjacent the portion of the hydrocarbon wellbore tubular in the hydrocarbon production wellbore comprises:

determining, with at least one accelerometer of the detonator control system, that the housing is substantially stationary within the hydrocarbon production wellbore;

determining, with a timer of the detonator control system, that a predetermined time period subsequent to the determination that the housing is substantially stationary within the hydrocarbon production wellbore has expired; and based on the determination that the predetermined time period has expired, providing the detonator activation signal for the detonator with the detonator control system to detonate the explosive material.

20. A wellbore tubular cutting apparatus, comprising:

a partially spherical metal housing that encloses an explosive charge, the partially spherical metal housing configured for deployment through a production wellbore independent of untethered to a working string or a downhole conductor, the partially spherical metal housing comprising an uphole end that is spherical and a downhole end that is conical;

a detonator embedded in the explosive charge, the explosive charge sufficient, when detonated, to fragment the partially spherical metal housing and sever a wellbore tubular with the fragments, the explosive charge, or both; and a control system communicably coupled to the detonator and configured to perform operations comprising:

determining that the partially spherical metal housing has reached a particular position in the production wellbore; and transmitting a detonation signal to the detonator to detonate the explosive charge.

21. The wellbore tubular cutting apparatus of claim 20, wherein the partially spherical metal comprises a steel housing.

22. The wellbore tubular cutting apparatus of claim 20, wherein the explosive charge is enclosed within a volume of the partially spherical metal housing.

23. The wellbore tubular cutting apparatus of claim 22, wherein the volume comprises a center portion that encloses the explosive charge and a plurality of nozzles that extend toward a wall of the housing from the center portion.

24. The wellbore tubular cutting apparatus of claim 23, wherein each of the plurality of nozzles comprises a first dimension adjacent the center portion that is larger than a second dimension adjacent the partially spherical metal housing.

25. The wellbore tubular cutting apparatus of claim 20, wherein the detonation signal comprises an electrical charge.

* * * * *